US005797194A

United States Patent [19]

Zettergren

[11] Patent Number: 5,797,194

[45] Date of Patent: Aug. 25, 1998

[54] MOBILE MICROWAVE DRYER

[75] Inventor: Leif Zettergren, Jarfalla, Sweden

[73] Assignee: Microz Sweden AB, Jarfalla, Sweden

[21] Appl. No.: 702,616

[22] PCT Filed: Mar. 2, 1995

[86] PCT No.: PCT/SE95/00219

§ 371 Date: Oct. 24, 1996

§ 102(e) Date: Oct. 24, 1996

[87] PCT Pub. No.: WO95/23945

PCT Pub. Date: Sep. 8, 1995

[30] Foreign Application Priority Data

Mar. 2, 1994 [SE] Sweden ..... 9400715

[51] Int. Cl.[6] ..... F26B 3/34

[52] U.S. Cl. ..... 34/259; 34/264; 34/495; 34/216; 34/237; 219/696; 219/10.55 A; 404/77; 404/94

[58] Field of Search ..... 34/269, 264, 486, 34/491, 495, 202, 204, 209, 210, 216, 217, 237, 259

[56] References Cited

U.S. PATENT DOCUMENTS

| | | | |
|---|---|---|---|
| 4,175,885 | 11/1979 | Jeppson | 404/77 |
| 4,256,944 | 3/1981 | Brandon | 219/10.55 |
| 4,370,534 | 1/1983 | Brandon | 219/10.55 |
| 4,765,713 | 8/1988 | Matsuo et al. | 385/145 |
| 4,765,773 | 8/1988 | Hopkins | 404/94 |
| 5,296,666 | 3/1994 | Varadan et al. | 219/696 |
| 5,441,360 | 8/1995 | Long et al. | 404/77 |

FOREIGN PATENT DOCUMENTS

| | | |
|---|---|---|
| 8500617 | 9/1986 | Sweden . |
| WO92/08084 | 5/1992 | WIPO . |

*Primary Examiner*—Henry A. Bennett
*Assistant Examiner*—Pamela A. Wilson
*Attorney, Agent, or Firm*—Pollock, Vande Sande & Priddy

[57] ABSTRACT

The present invention is an improved method and apparatus for supplying electromagnetic energy to a body having at least one substantially planar surface comprises moving over the planar surface a self-propelled container housing a source of electromagnetic energy and having an open side which is substantially perforate to the electromagnetic energy thereby permitting transmission of the energy from the container to the body while all other surfaces of the container substantially block transmission therethrough. Concurrently with the movement of the container responding within the container to at least one selected parameter to control the movement of the container over the planar surface.

10 Claims, 2 Drawing Sheets

MOBILE MICROWAVE DRYER

BACKGROUND OF THE INVENTION

The drying of building components, such as joist frames, walls, ceilings, exterior wall surfaces etc. is required in construction and repair work. At new production, construction times are rather long therefore making air heating and other conventional drying methods practicable. In spite of that, there are frequently reasons to make arrangements to speed up drying also in new production.

In connection with renovation of old bathrooms and repairs after water damage, one of the most difficult problems is the long drying times, which often may extend to 6–8 weeks. In bigger projects within the repair, rebuilding, enlarging sector, the work proceeds along one or more water and sewage mains at a time, i.e. that in a four story house four bathrooms are put in order at the same time. A single instance of water damage discovered at the removal of the surfacing causes disorder in the complete plan.

Demands that the repair should take as little time as possible are the rule rather than exception. Every delay brings with it costs, as apartments and other premises cannot be used as intended in the meantime. Ideally, drying and connecting repair will be made rapidly enough to require none or only insignificant restrictions in the use of the premises.

Several different ways have been proposed. Examples are making holes and blowing with dry air, electric heating, etc.

Recently the use of microwaves has been proposed. Use has been made of long microwave generators, which are inserted into drilled holes, and of directed microwave radiation without making any holes. This latter technology was already at the end of the seventies used for producing and maintaining composite tracks consisting of a, sometimes reinforced, concrete structure with a top layer of asphalt. See U.S. Pat. No. 4,175,885.

This technology has later been adapted for use in buildings. The state of the art is described inter alia in the international patent application with the publication number WO 92/08084.

Microwave technology brings with it progress but a string of problems remain. Microwaves have a relatively short range and must, for reasons of safety, be well shielded to protect the operators against radiation. Each unit is capable of drying only a relatively small area at a time.

The technology described in WO 92/08084 requires extensive supervision and much work for moving the equipment. This is, with respect to safety and ergonomy, a work environment problem. The wheels mentioned in the publication reduce the need for heavy lifting but do not reduce the need for supervision. The equipment is useable just for floors or slightly inclined surfaces but not for ceilings and walls.

The need for essentially, permanent supervision has, to a high degree, restricted, the usefulness of microwave drying.

The inventor has looked for other ways resulting in increased safety, reduced need for supervision, simplified handling and possibility to let the dryer equipment work day and night, thereby considerably increasing the usefulness of the microwave technique.

The basic inventive concept is to use programmed, electrically controlled movement of one or more microwave units along one or two rails and/or along one or more screws. Displacement along rails is preferred, when drying floors and other horisontal surfaces, and along screws when drying walls. Combinations of movements along rails and screws may be suitable at the drying of large wall areas. When drying ceilings or walls one or more screws may be used to place the dryer unit at the desired level and rails to govern its lateral movement.

SUMMARY OF THE INVENTION

According to one embodiment of the invention each microwave unit has wheels or is supported by a carriage provided with wheels. Such a unit or carriage respectively is moved along one or more rails. The propelling force is generated either by a motor on each microwave unit or carriage or by a pulling arrangement.

According to another embodiment, one or more microwave units are carried by a lifting stand, for instance of pillar type, i.e. where the lifting function is performed by a motordriven screw mounted in a guide. The lifting stand may also be provided with wheels and motor propelled and moved along one or more rails. The movement can be controlled by the automatic device mentioned earlier.

The movement, which may be carried out step by step or continuously, is governed by a programming unit. Suitable parameters for control are time, temperature, and the drying result attained.

In a preferred embodiment of the invention, the displacement is carried out by use of track wheels on twin rails. This gives a more stable movement and high flexibility, when adapting the dryer equipment to different needs. One can, using very uncomplicated means, adapt the dryer equipment to the drying of of ceilings as well as interior and exterior walls.

The displacement may occur continuously or step by step. At drying connected with cleaning up after a water damage, step-by-step movement is preferred. Hardened concrete is relatively insensitive to uneven heating and the same applies to most other constrution material. Step-by-step drying gives increased efficiency and better control of the result. The movement from one area to the next, may for instance be time controlled, temperature controlled, or controlled by the humidity in the outgoing air. The choice of control parameter is made with respect to the special demands of each application. In most cases time control is used.

The rails may be made of pipes of different dimensions, which are inserted into each other. One obtains in this uncomplicated way a telescopic function that makes the rail length easily adaptable to different room dimensions. The rails are easy to mount and demount. The material may be PVC of the type used for electrical installations. Rails of this kind are preferred as they are commercially available with suitable dimensions for insertion into each other. To the extent that other pipe or rail types with suitable properties are available, there are, of course, no objections to using them.

That the movement occurs step by step should be understood in the sense that the unit after start remains at the same place until a predetermined time, temperature, or humidity in the outgoing air has been reached. Thereafter, the unit advances a predetermined distance and remains in this position until any of the above mentioned parameters has assumed the predetermined value, and then advances another predetermined distance. The step-by-step movement continues until the end position has been reached. In this position, movement is stopped by a switch and the unit will stand still during the period mentioned above and is finally switched off. The step length may be the length of one unit or shorter. The latter is preferred as the drying effect is better just under the magnetron and decreases farther out. Thus, a certain overlapping is desired.

The automatic control reduces the need for supervision and makes it possible to use microwave technology even for large areas, as for instance the drying of water flooded surfaces after fires and mold sanitizing in so-called sick houses. For this latter purpose, microwaves are especially suitable, as they are able to kill insects, insect ovums and larvae, mites and mite ovums, microorganisms of different kinds, fungi including molds, algae, spores etc., which otherwise may live on and start new centers of attack.

The automation makes the safety demands easier to fulfil in a more uncomplicated way than described in the PCT-application mentioned above. Already the reduced need for supervision means reduced need for staff to stay in the vicinity of the radiation source and brings, in this way, increased safety.

Further, the new technology offers opportunities of remote control and preblocking to ensure that cut off occurs as soon as anyone enters the danger area. Safety can be increased still further by room screening using aluminized films or composites of aluminium films and paper, or plastic of the types used for packing purposes. The safety systems may consist of photocells, movement sensors, infralight sensors etc. but more conventional methods with "roller blind screening" and uncomplicated electric contact switches are useable too. By a locking system that makes sure that only qualified operators having keys are able to restart the microwave dryers after cut-off is ensured that unintended breaches of the safety rules cannot endanger people.

This invention concerns an improved way of providing energy in the shape of microwaves to bodies limited by at least one approximately plane firm surface, especially floors, walls, masonry, exterior surfaces and ceilings. The treatment may concern drying, mould sanifying, insect eradication etc. The method comprises the movement of a dryer unit having at least one magnetron capable of generating microwaves over the area that is to be treated along one or more rails or along one or more screws.

The invention also concerns an arrangement consisting of one or more units (1) containing at least one magnetron (2) for the generation of microwaves, one propelling unit (3), which may be integrated with the unit(s) (1), for the displacement of the magnetron containing unit and a control system (4), which may also be integrated with the unit(s) (1), for the programmed control of the displacement.

Preferred embodiments of the invention also include a safety cut-off switch (5), an end-stop switch (6) and an overheating protector (7). The overheating protector is suitably of the type that cuts off at too high a temperature and automatically restarting the unit when the temperature has decreased. The movement occurs with advantage along twin governing rails (8), which at their end stop positions have crossbeams (9) that act upon the end stop switch (6). The end stop switch has a crossbar which sweeps over the area between the rails and stops the unit if unforeseen obstructions such as stones or high irregularities should be present in the track.

In an especially preferred embodiment of the invention the sensor organ of the safety switch (5) in contact with rails or firm surfaces consists of a wheel, which may have approximately the same diameter as the drive wheels. This wheel is positioned at the end of a spring loaded arm urging the wheel against the rail or other firm surface. The upper part of the arm acts upon the switch. An advantage of this arrangement is good reliability irrespective of whether the dryer is working on horizontal, up or down directed surfaces, or against vertical surfaces. For further safety, the wheel is protected by a protective plate, which makes it impossible unintentionally to press up the sensor in connection with, for example, lifting movement. Further, usually two safety switches positioned at each side of the microwave unit are used.

If desired, the safety against leakage of microwaves through the gap between the edge of the magnetron encasement and the support may be increased by a "skirt" which may consist of a flexible metallized material, for instance the earlier mentioned metallized sheet material, or of metal bristles.

The programmed control may with advantage be done by a microcomputer. One microcomputer can control several units at the same time. In this case, it is appropiate to use a separate control unit which, by cable, is connected to the different dryer units. A separate control unit makes it easier to ensure reasonable safety for operators and others in the vicinity of the dryer subject.

BRIEF DESCRIPTION OF THE DRAWINGS

FIG. 2. shows a front view of the arrangement in FIG. 1, and.

DETAILED DESCRIPTION OF THE DRAWINGS

In the figures (1) is the microwave unit, (2) is a magnetron, (3) for the propelling unit, (4) f or the governing unit, (5) for a safety switch, which will be activated if the sensor wheels (23) are not in contact with the governing rails (8) or other firm support, (6) the end stop switch, (7) is an overheating protector, (9) is a crossbeam which arrests the dryer unit at the end position, (13) a ventilator, and (16) an air intake, which is provided with a filter and covered with a screen acting as a shield against the microwaves. Item (18) is a perforated plate, which permits air passage but hinders emission of microwave radiation.

Figure 1:
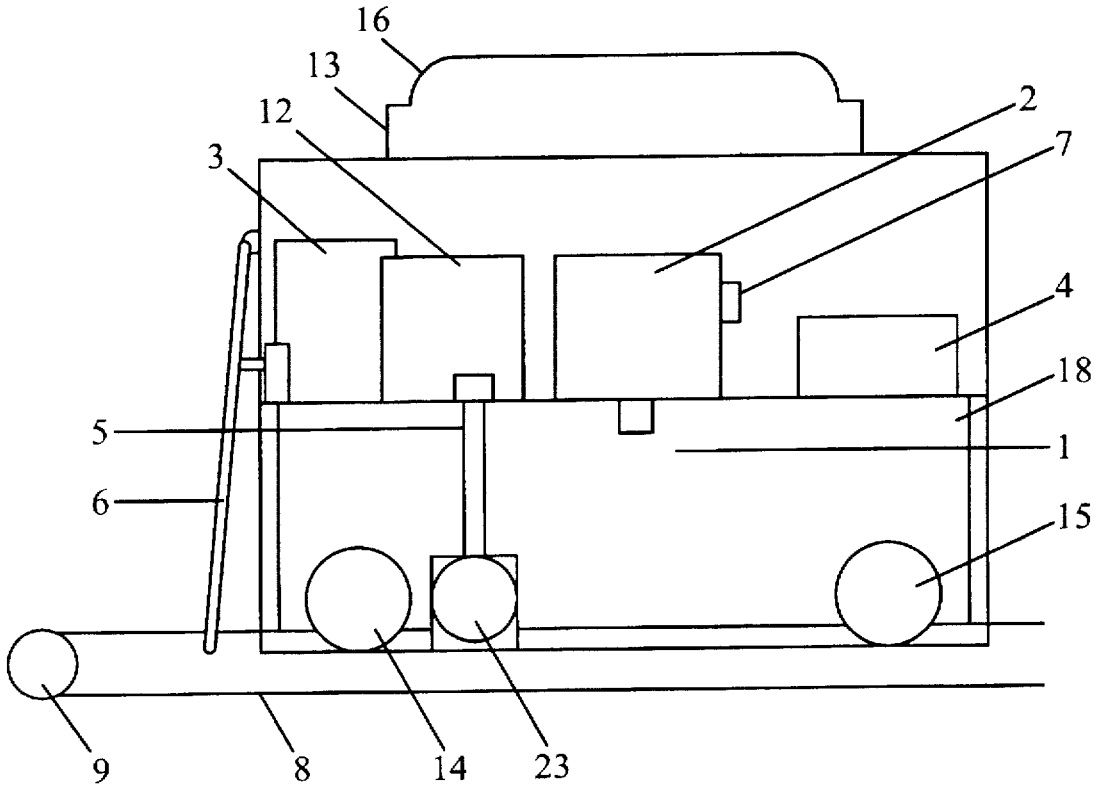
FIG. 1. shows a side-view of a preferred arrangement according to the invention. The front, the rail and the protector plate for the safety switch have been made "transparent" to show Interior structures. The machine runs on rails and is shown close to its left end stop position on the rails.
Figure 2:
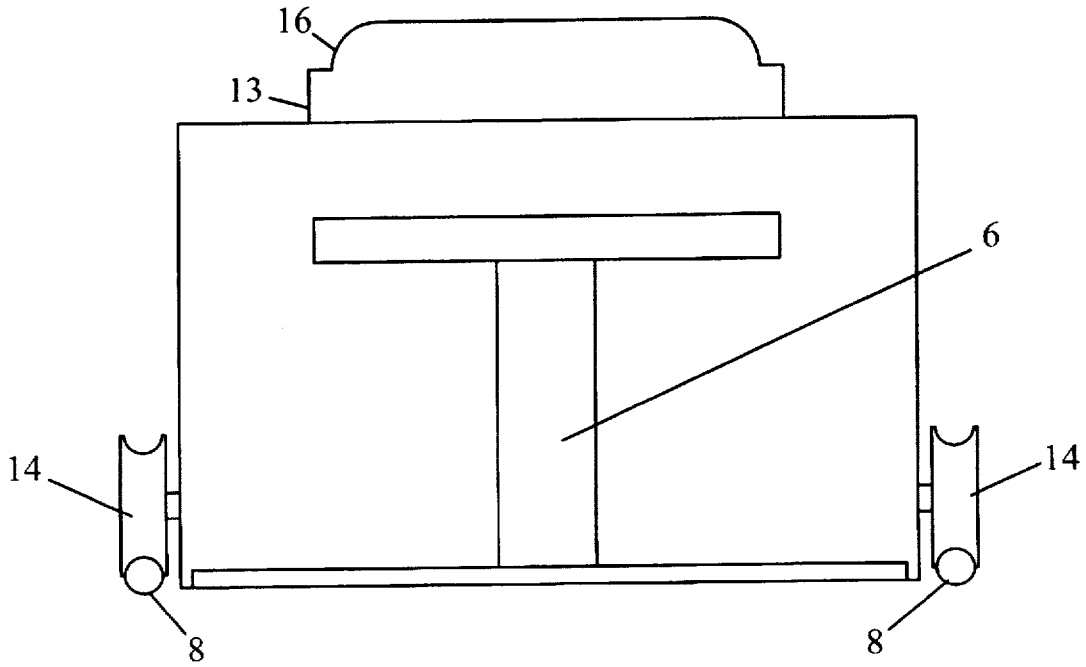
Figure 3:
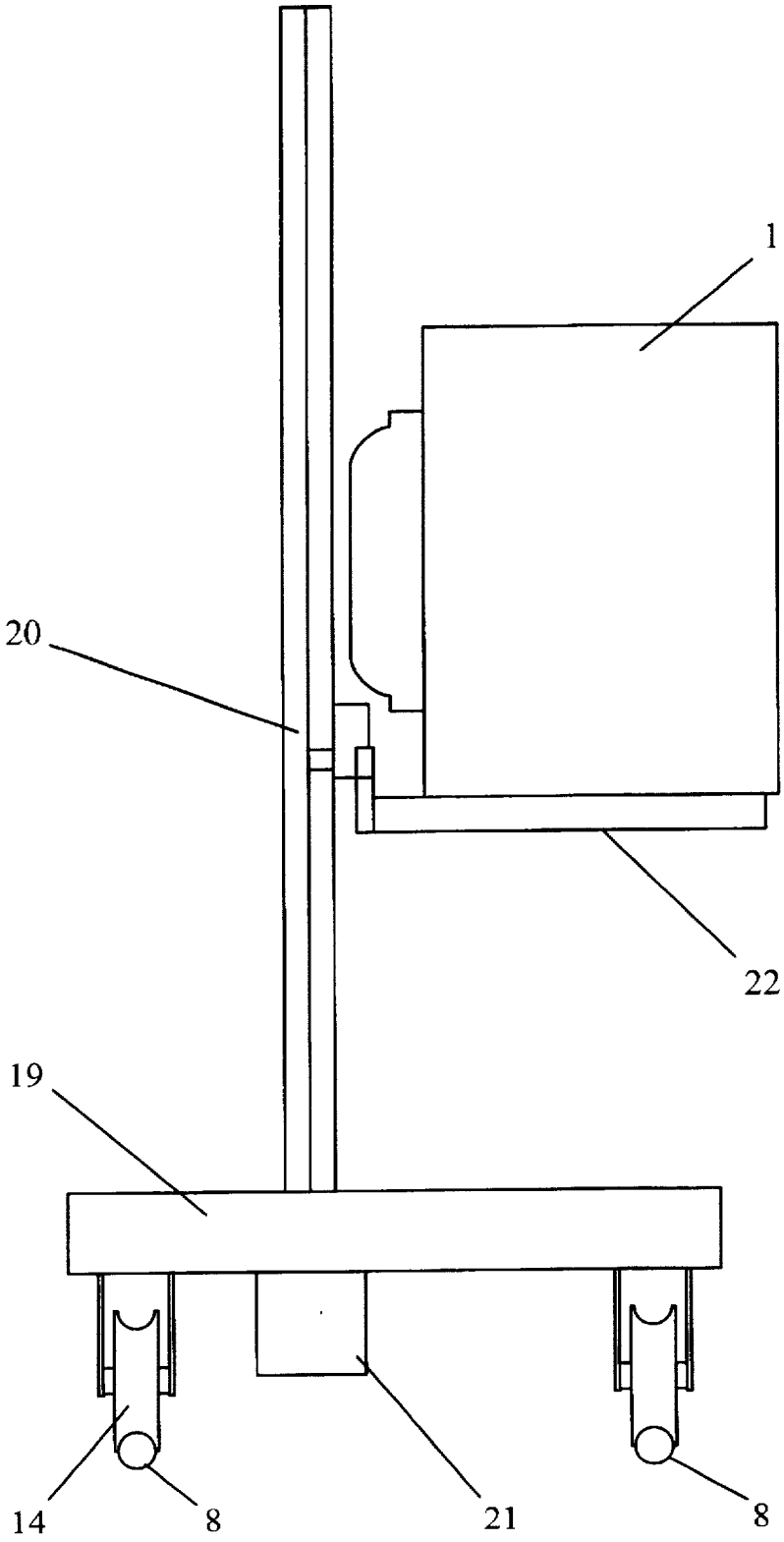
FIG. 3 shows a side-view of a row of dryers carried by a rail supported pillar carriage with a motordriven automatically controlled screw with a guide.

Additionally, (19) shows a lifting stand, (20) is a screw and guide, and (21) is a motor and control unit, which are situated inside an encasement under the lower end of the screw. Element (22) is a lifting frame, which can be adapted to support the units in side position (as shown), right, or upside-down. The equipment (not shown) for propelling, controlling and safety details corresponding to those shown in FIGS. 1 and 2 may be the same as shown and described in connection with FIGS. 1 and 2.

The perforated plate may extend down to the lower edge of the encasing plate to significantly improve protection against leakage of microwaves. The air outlet is positioned close to the surface that is to be dryed to prevent the generation of a stagnant, humidity saturated air layer close to the surface.

When the equipment is used in areas that are not well ventilated, the water content in the outgoing air may be high enough to cause condensation on surrounding surfaces. In such cases the ventilation can be improved by the addition of ventilators for outgoing ventilation air. Generally, good air circulation makes sure that the unit is not working with recirculating humid air and is a prerequisite for good results. Low temperatures in the premises where the equipment is used better the result of the drying.

This new technology brings about big advantages. The drying time is reduced to a few days, compared to 6 to 8 weeks as mentioned above. The time needed can be precalculated with good precision and the project planning is simplified. Thanks to the automation, the need for manual work is markedly reduced. Energy consumption is significantly reduced as compared to now prevalent methods, because the drying energy may be applied selectively to only those surfaces that need drying. Energy losses caused by the heating of large room volumes and dehumidification and heating of drying air are eliminated.

The water is vaporized inside the material. The easier migration of the water vapor compared to liquid water is taken advantage of. Pores in building material retain water by capillary force. This is lesser for vaporized water. The checking of the drying result attained is facilitated. Last, but not least, the inherent selectivity makes it easy to discover and localize pipe leaks inside the material.

The reduction of energy consumption constitutes a substantial ecological progress. An added advantage is that microwave treatment, as mentioned above, is able to kill insects, insect ovums and -larvae, mites and mite ovums, microorganisms of different kinds, fungi including rot fungi and moulds, algae and spores. This is of special value when sanitizing sick houses and drying up after water damages, especially where infected water has penetrated the material. From the ecology point of view, it is an enormous progress that sanitizing of this kind can be accomplished withouth the use of poisonous and environmentally dangerous chemicals.

This new technique is easily adaptable to drying and treatment not only of floors and inclined surfaces. It may, by very uncomplicated means, be adapted to the drying of ceilings and walls. At ceilings the dryer unit can be turned upside-down and positioned on rails, which in this situation get a position diametrally opposed to the one in FIGS. 1 and 2. The rails are supported by a scaffold with capability of height adjustment.

The same rails may be used in the drying of walls. The microwave unit is placed in side position on a rail carriage in such a way that the lowermost of the drive wheels (14) is coupled to the carriage's wheel that rests upon the rail and propels the carriage.

As an alternative to this, the microwave unit may be supported by a horisontal pair of rails where the upper rail is located at the approximative distance of one wheel diameter from the wall and outside (with respect to the wall) the upper wheel of the microwave unit. The lower rail contacts the wall and supports the lower wheels of the microwave unit. In this method usually just three wheels are used, one being the drive wheel. To reduce, if needed, the load on the upper rail, different types of support arrangements may be used, e.g. running wheels, support rollers etc.

Another possibility of good usefulness for ceilings as well as walls is to place one or more microwave units on a shelf supported by a height adjustable stand. At walls, the height adjustment may be controlled by the automation. One method to do this is by using a motordriven screw inside a guide of the type used for lifts and lifting carriages etc. The movements of the screw are also controlled by the automation that is used to control its other units. If one of the units has the side with an end stop switch facing upwardly, its signal may be used to stop the machinery when approching the ceiling.

The stand may be provided with motordriven wheels. To better the stability and facilitate governing and control, the wheels should be supported by rails. In this design, the end stop switch mentioned in the preceding paragraph may be used to supply the control unit with a signal that, after the delay needed to complete the drying in the highest position, reverses the screw rotation and lowers the units to the lowest level, where the motor propelled rail-supported wheels can move the wheel carried stand to a new position for restart of the lifting movement of the screw. The microwave units that are foremost in the direction of the horizontal movement of the stand should have an end stop switch at their front side and stop the operation, while awaiting operator control, when the wheel-supported stand approches the wall. Alternatively, the stand itself may have this function included.

Beside drying and mould sanitizing, arrangements according to the invention are suitable for a large number of different applications, where energy which penetrates the surface must be provided. Some examples are the thawing of ice-blocked plastic pipes, especially when located inside concrete structures, the removal of paint, tape, sealants etc. from different surfaces including window-panes, eradication of longhorned beetles and other wood eating insects, mites, wood eating ants and termites, house fungi and other rot fungi and spore sanitizing. A great advantage of sanitizing according to the proposed method is that it may be carried out without removal of damaged timber. Removal of damaged timber always means that a substantial amount of good timber will be removed too. In addition to problems with substituting the timber there follows the unnecessary loss of supporting strength.

Another example of suitable use areas for this new technique is the drying of exterior walls as preparation for silicone treatment or application of other types of humidity protection. It may also with advantage be used for the drying of cellar foundations and walls after flooding damages. The method does not require hole drilling and and differs in this respect markedly from the technique that is proposed in Swedish patent application 8500617-9. In spite of that, an excellent result is obtained, especially if the drying is done in intervals with intermediate periods for moisture diffusion. To the extent improvement of the capillary breaking capacity is needed, this can be done with substantially less hole drilling than according to the mentioned older technique.

The microwave technique is also very suitable for drying moisture in filling joists and other structures with several layers. In those cases, one makes holes in the upper firm layer along two opposed sides and forces in air, as cold and dry as possible, at one side and letting the air be sucked out or trickle out at the other side. The microwave unit is moved over the upper surface as described before. Analogue techniques may avantageously be used on walls filled with insulating material. The new technique brings a drastic reduction of the drying time and eliminates frequently the need for demolitions to make the moisture spots available.

The new application of microwave technology, as compared to older techniques for the drying of filled structures and walls, requires lower energy consumption and yields a much faster drying with a more reliable final result. The use of easier prior art technique makes the drying of wood inside joists very problematic. This is true especially for wood inside concrete and light concrete constructions. By using the new technique, the drying may most frequently be done without demolition of existing construction.

An interesting way of using the technique according to the invention is together with a plastic mat with small projections, which create a thin air layer between the support and the mat. Example of such a mat is the one that is marketed under the trade mark PLATON. Such mats are usually used when installing a wooden floor on, for instance, a concrete floor resting on a bottom slab. By blowing in chilled and dryed air, passing under the mat, and heating the concrete support by microwaves through the mat, a very efficient drying of the floor is obtained. As a secondary effect, a warm floor is obtained, and it is possible to adopt the technique to permanent use for this purpose.

If the equipment can tolerate water flooding, it may also be used outdoor for the drying of water-damaged, dressed, or undressed, brick and light weight concrete fronts and walls to prevent frost bursting, and as a preparation for treatment with silicone solution or other moisture protection to prevent new water damages.

An interesting application is the drying of floors insulated with multilayer plastic sheet in bathrooms and similiar spaces, where moisture has penetrated under the cover. By drying from the upper side as well as from below, the damage can be repaired without removal of the covering layers. An advantage when drying from underneath, i.e. from the ceiling in the bathroom below, is that moisture-proof paint falls of by itself. The frequently difficult procedure often needed to remove the paint is eliminated.

I claim:

1. An improved method of supplying electromagnetic energy to a body having at least one planar surface, said method comprising the steps of:

moving over the planar surface a self-propelled container comprising a housing containing therein a source of electromagnetic energy, providing said container with one side which is substantially flat and perforate to said electromagnetic energy all remaining surfaces of said container being imperforate to the transmission of electromagnetic energy therethrough, thereby permitting transmission of the energy from the container to the body through said one side;

concurrently with the movement of the container, responding to at least one selected parameter to automatically control limit of movement of said container over said planar surface, and terminating movement of said container in the event said container reaches a predetermined limit of movement of said container.

2. An apparatus for supplying energy to promote drying and sanitization of flat surfaces, comprising:

at least one magnetron for the generation of microwaves;

a housing unit supporting said at least one magnetron and propelling means adopted for moving said housing with said at least one magnetron over a predetermined path about said flat surface;

said housing unit having a single substantially planar outer surface perforated to permit transmission of microwaves through said outer surface of said housing thereby permitting drying and sanitation of said flat surface;

and control means for governing movement of said at least one magnetron in response to at least one selected parameter.

3. The apparatus of claim 2 wherein said propelling means includes a plurality of wheels rolling on at least one rail.

4. The apparatus of claim 3 further comprising a crossbeam positioned at the end of said at least one rail and said unit having an end stop and means connected thereto for stopping movement of said at least one magnetron housed in said unit.

5. The apparatus of claim 2 wherein said at least one rail is formed of a plurality of pipes of different dimensions to permit insertion of one into another.

6. The apparatus of claim 2 wherein said apparatus is used for drying and sanitization of ceiling surfaces and said at least one rail is supported by an adjustable support means for adjusting distance between said unit and said surfaces to be subjected to drying and sanitization.

7. Apparatus for supplying energy to promote drying and sanitization of flat surfaces comprising:

at least one magnetron for the generation of microwaves;

a housing supporting said at least one magnetron and propelling means for moving said at least one magnetron over a predetermined path; and control means for automatically governing movement of said at least one magnetron in response to at least one selected parameter; and wherein said propelling means includes a plurality of wheels rolling on at least one rail and an adjustable support means for supporting said rail at an adjustable distance from a surface to be dried and subjected to sanitization.

8. A device according to claim 7 wherein said supporting means includes a height adjusting scaffolding.

9. Apparatus for supplying energy to promote drying and sanitization of flat surfaces comprising:

at least one magnetron for the generation of microwaves;

a housing supporting said at least one magnetron and propelling means for moving said housing with said at least one magnetron over a predetermined path;

control means for automatically governing movement of said at least one magnetron in response to at least one selected parameter;

wherein said propelling means includes a plurality of wheels rolling on at least one rail, and wherein a crossbeam is positioned at the end of said at least one rail, and said unit has an end stop and means connected thereto for stopping movement of said at least one magnetron.

10. The apparatus of claim 9 wherein said at least one rail includes a plurality of pipes of different dimensions to permit insertion of one into another.

* * * * *